United States Patent [19]

Porter

[11] Patent Number: 4,878,590

[45] Date of Patent: Nov. 7, 1989

[54] RECEPTACLE COVER FOR PREVENTION LOSS OF TRAYS WITH TRASH

[76] Inventor: James L. Porter, Thayer, Mo. 65791

[21] Appl. No.: 279,923

[22] Filed: Dec. 5, 1988

[51] Int. Cl.[4] ..... B65D 25/02

[52] U.S. Cl. ..... 220/1 T; 220/404

[58] Field of Search ..... 220/1 T, 253, 254, 400, 220/402, 403, 404

[56] References Cited

U.S. PATENT DOCUMENTS

| | | | |
|---|---|---|---|
| 816,989 | 4/1906 | Moler et al. | 220/404 |
| 1,227,964 | 5/1917 | Shepperd | 220/1 T |
| 2,112,465 | 3/1938 | Maish | 220/403 |
| 3,191,798 | 6/1965 | White et al. | 220/404 |
| 4,487,331 | 12/1984 | Hawker | 220/404 |
| 4,494,657 | 1/1985 | Oldenkamp | 220/1 T |

FOREIGN PATENT DOCUMENTS

| | | | |
|---|---|---|---|
| 2500381 | 7/1975 | Fed. Rep. of Germany | 220/1 T |
| 0401609 | 11/1933 | United Kingdom | 220/400 |
| 1064663 | 4/1967 | United Kingdom | 220/1 T |
| 1315906 | 5/1973 | United Kingdom | 220/1 T |

*Primary Examiner*—Jimmy G. Foster

*Attorney, Agent, or Firm*—Gravely, Lieder & Woodruff

[57] ABSTRACT

A cover for a trash receiving open top container which is adapted to provide a shallow sloped surface leading to an opening that is sized to a dimension that is less than the smallest dimension of a tray on which trash is usually conveyed to be deposited in the container. The cover is needed to prevent the loss of trays into the container by persons who either allow a tray to slip into the container or simply shove the tray onto the cover and leave it unemptied. The cover is provided with a strengthened opening to prevent forceful insertion of a tray and it provides other openings to quickly drain off fluids and small items of trash.

4 Claims, 2 Drawing Sheets

RECEPTACLE COVER FOR PREVENTION LOSS OF TRAYS WITH TRASH

BACKGROUND OF THE INVENTION

1. Field of the Invention

The present invention is directed to a receptacle cover for preventing loss of trays along with the trash on the tray.

2. Description of the Prior Art

Trash receiving receptacles, whether formed of metal or plastic usually have a cover for enclosing the trash and objects cast into the container. In a very early form of a receptacle adapted to receive and enclose furnace ash was disclosed in Bauer U.S. Pat. No. 1,160,820 of Nov. 16, 1915, the ash receiving container is placed inside an enclosing structure which keep down dust and hides the container. Access to the container is provided by a movable door that is caused to swing inwardly when ash is to be deposited in the container. The ash is intended to be directed into the container by a funnel structure having slanting surfaces which terminate at a central opening aligned with but spaced above the container. The enclosing structure retains dust that is stirred up when ashes are shoveled through the door and dumped on the funnel structure.

Another example of prior art is the Olsson U.S. Pat. No. 3,815,774 of June 11, 1974 which has disclosed a sloped down retainer cover for a trash or waste container in which the sloped surface has yieldable folds which are expandable so that waste can flex the surface and enter the container through a bottom opening that expands as the folds expands. The Olsson retainer device has a function to allow an increase the size of the bottom opening to pass waste and then decrease the size of the opening to prevent waste escaping from the container.

A further example from the prior are in the Netherlands Patent 8402344 of Verhoog which is a self-extinguishing refuse container that exhibits a special function of extinguishing a fire by collecting smoke to exclude air that would feed a fire.

The problem which the prior art has not addressed is the lack of provision in the trash container art to supply the usual trash receiving container with a cover that will allow the trash to pass into the container while arresting the passage of the tray which is used to deliver such trash. This problem is one that the fast food concerns have faced for a long time without finding a solution. If trays are carelessly allowed to pass into the trash containers it is highly likely that no one will retrieve the tray. Since trays supplied by the fast food concerns are expensive, the loss of trays can add up to a substantial loss and a drain on profits. There is the further problem that trays are not retrieved due to the unsanitary handling of food and related objects that are germ carriers and discourage retrieval by employees or the public.

BRIEF DESCRIPTION OF THE INVENTION

It is an important object of the present invention to provide a trash receptacle cover that will accelerate the passage of trash, food scraps, and used napkins into a container while preventing the passage of the tray used to deliver such, trash to the container. The loss of trays is an expensive and costly one for operators of fast food establishments where the customer is given a tray to carry the food to the table for consumption, and is then instructed to take the tray and the trash to a container that is provided in an enclosed structure where the tray and contents is pushed into the enclosing structure and the trash is supposed be dumped off the tray and into the container. It frequently happens that customers can carelessly or purposely let go of the tray which then is deposited in the container and is seldom recovered by attendants in the establishment.

It is a further important object of the present invention to provide the container with a cover that is shaped to direct the trash into the container through an opening that is sized so as to prevent a tray from passing into the container through the trash opening, whereby the loss of trays is practically eliminated without any extra duties imposed on employees of the establishment.

The present invention is embodied in a combination in which an open top refuse or trash container is provided with a cover comprising a body having a funnel or conic surface presenting an opening aligned with the container, and in which the opening is sized at its maximum dimension to be less than the smallest dimension of a tray utilized to deliver refuse or trash to the container, whereby the shape of the cover will encourage the passage of refuse into the container while arresting the passage of the tray on which the refuse or trash is brought to the container.

It is a further embodiment of the invention to select a shallow slope for the cover, and to provide openings in one or more of the sloped surfaces for accelerating the disposal of the trash through the cover which makes it easy to clear a tray of the trash before depositing the emptied tray outside the trash container.

BRIEF DESCRIPTION OF THE DRAWINGS

The embodiment of the present invention is represented by a preferred structure which is seen in the accompanying drawings, wherein.

DETAILED DESCRIPTION OF THE INVENTION

Figure 1:
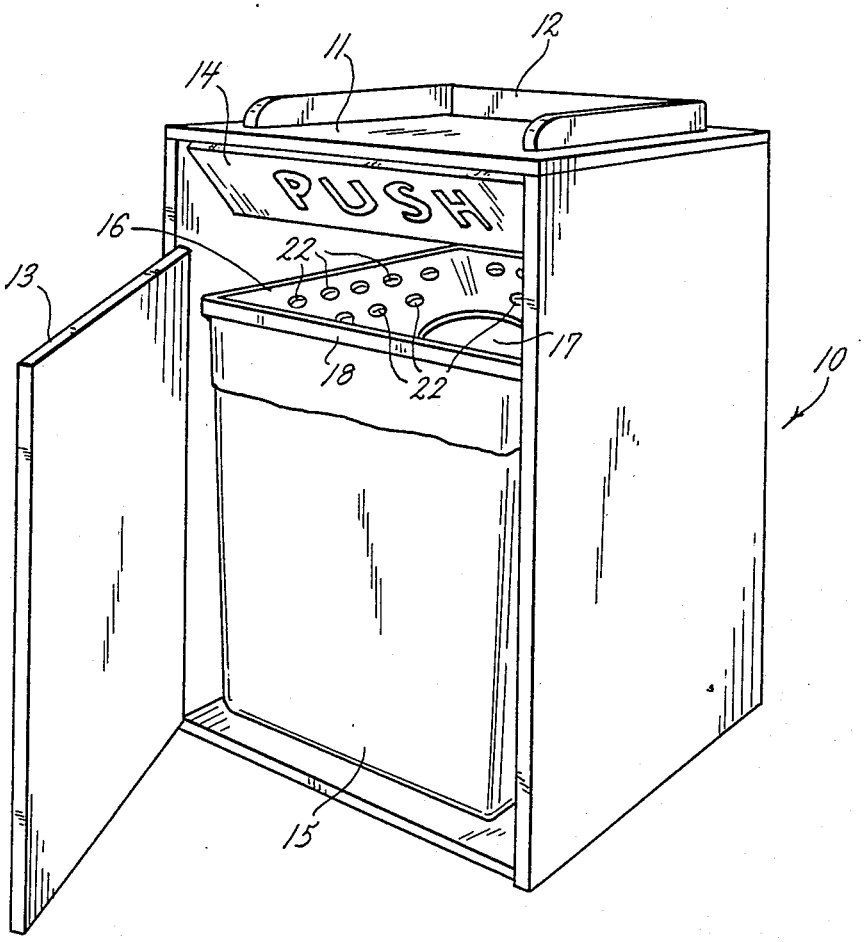
FIG. 1 is a perspective view of a typical cabinet structure adapted to receive trash containers having the usual plastic trash collecting bag drapped over the opening top of the container, and a container cover seen in place with the access door to the cabinet in open position.

Directing attention to FIG. 1, the cabinet structure 10 follows a well known typical configuration having a top surface 11 with marginal guides 12 to receive and retain empty trays. The front of the cabinet is controlled by a hinged door 13, and by a hanging closure 14. When the door 13 is open a plastic trash container 15 can be inserted and its cover 16 can be seen in a position below the hanging closure 14. The cover is removable from the container 15. When the door is closed the container and its cover are completely hidden, but access is easily obtained by a customer pushing on the hanging closure 14 and resting the tray on the upper edge of the door 13 (which will be closed at that time) while allowing the trash to slide onto the cover 16 so that it will fall through the cover opening 17 and into the plastic bag positioned in the container 15.

Figure 2:
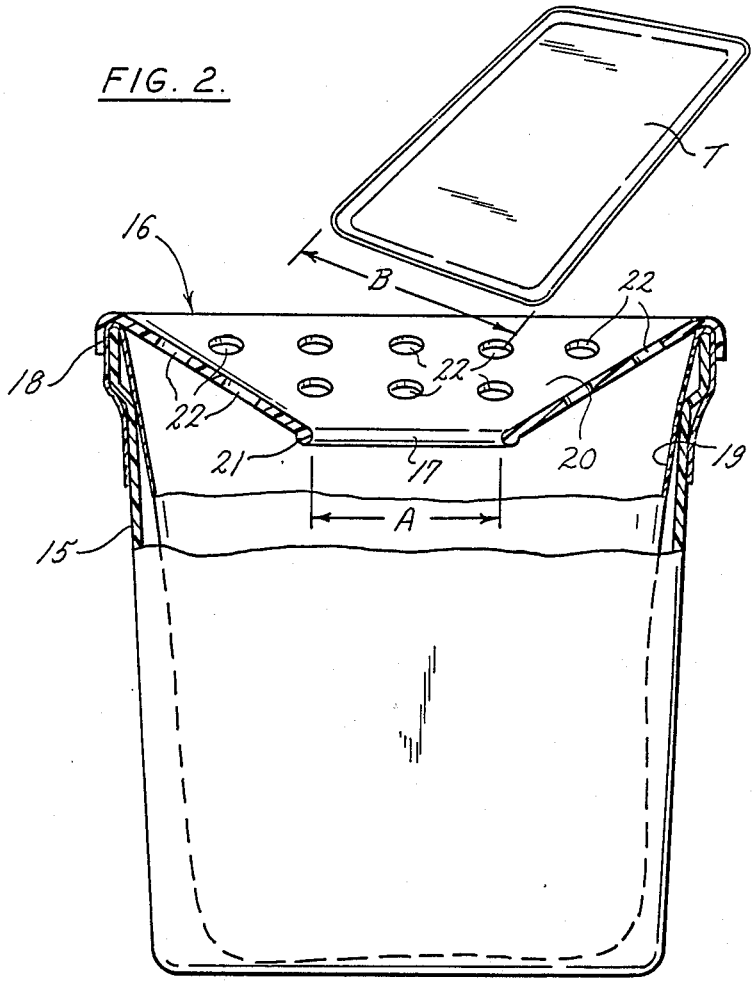
FIG. 2 is an enlarged and fragmentary sectional view of a container and a cover in position over the container opening.
Figure 3:
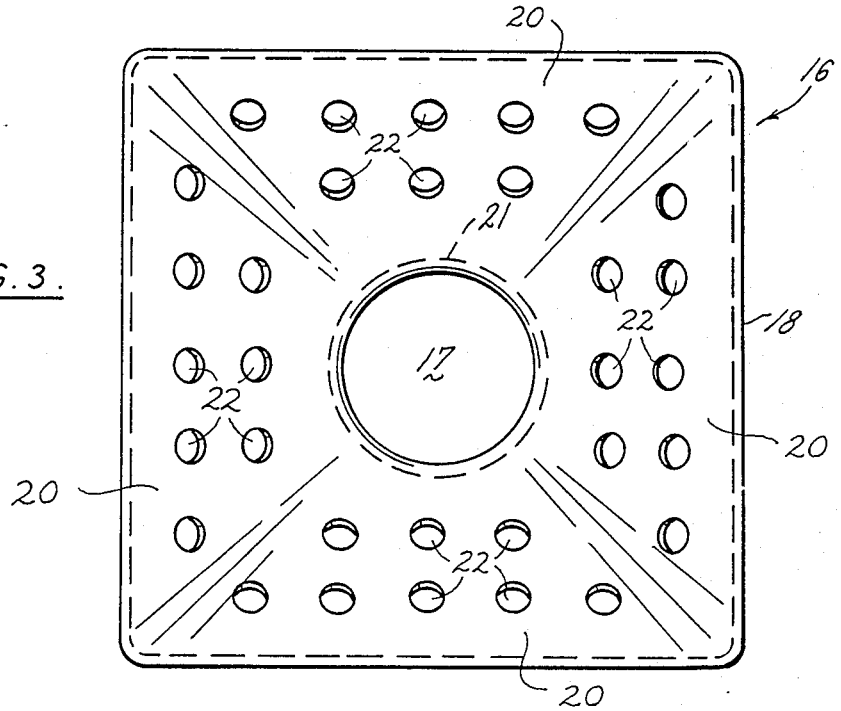
FIG. 3 is a top plan view looking down onto the cover.

It can be seen in FIGS. 2 and 3 that the plastic container 16 is provided with an upper rim 18 that is suitably formed to allow a plastic bag 19 to be drapped over the rim 18 with sufficient length of the plastic bag opening to drap itself down at the outside of the rim 18. The cover 16 may be a molded plastic member having a slopped or funnel shaped surfaces 20 at all four surfaces of the cover 16 which are directed to converge on the opening 17.

As previously pointed out, the uniqueness of the present invention is found in forming the cover 16 with its opening 17 having a maximum dimension A that is less than the minimum dimension B of a food carrying tray T. Such trays T are usually rectangular. with a slightly raised flange so that the food, drinks and other objects will remain on the tray while it is being carried from the surface counter to a table for consumption. After a customer has completed a meal, all of the trash is suppose to be replaced on the tray T and taken to the cabinet 10 where the closure 14 can be pushed to its open position while the contents on the tray is dumped onto the cover 16 as shown in FIG. 1.

It is seen in FIGS. 2 and 3 that the central opening 17 is suitably stiffened by a bead 21 to forestall tearing of the material. The cover also is formed in its sloping surfaces 20 with a series of openings 22 so arranged that liquids and related refuse will drop through the openings to accelerate the clearing of the trays T, and the larger items will pass through the opening 17. Furthermore, the cover 16 is dimensioned to fit over a trash container, and has a shallow slope for the surfaces 20 to occupy a minimum of space inside the container. Thus, the cover opening 17 may be at a level of about four inches so as not to occupy space in the container that would prevent a full compliment of trash.

The problem that is encountered is that trays are either purposely or accidently released and would fall into the plastic bag and not be retrieved by an attendant. The present cover 16 has the unique function of preventing the tray T from falling through the opening 17 and into the plastic bag 19 because the dimension A of the cover opening 17 is made less than the minimum dimension B of the tray. Since the tray is caught on the funnel or slopping surface 20 of the cover it does not fall into the plastic bag, but leaves a sufficient area of the opening 17 to allow the trash and other material a clear space to fall through the opening 22 into the plastic bag. It is a further feature of the present unique cover 16 that it presents a smooth funnel or slopped surface 20 that is easily sanitized and maintained in a clean condition.

It is understood, in view of the foregoing disclosure, that the cover may be made from sheet material that can be formed in a suitable shaping machine or by a molding technique. The material of the cover is by preference selected from material that can be easily sanitized, and is sufficiently stiff so that a tray can be supported while the trash and other objects can pass easily through the holes 22 and down the surface 20 into the plastic bag which is placed in the container 15.

What is claimed is:

1. The combination with an open top refuse container to receive refuse dumped into the container, of a refuse carrying tray for transporting refuse to the container, and an external container cover comprising a body supported by and removably fitted with a downwardly sloped surface presented to receive refuse from said tray and direct it into the open top refuse container, said sloped surface being sized to cover the open top of the refuse container and being formed with a principal opening therethrough for directing refuse into the container placed on said sloped surface, and said principal opening having a fixed size in its largest dimension to be less than the least dimension of said refuse carrying tray, whereby the fixed size of said principal opening in said sloped surface will pass refuse into the container and arrest efforts to force the passage of said refuse carrying tray into the container.

2. The container cover set forth in claim 1 wherein said sloped surface is formed with a series of openings spaced from said principal opening, said series of openings being sized to be smaller than said principal opening.

3. The container cover set forth in claim 1 wherein said sloped surface is formed with a series of openings of lesser size than said principal opening sufficient to surround said principal opening.

4. The combination with an open top refuse receiving container in which refuse is dumped from a refuse carrying tray, of a container cover molded from plaster and having a rim for removably seating on the container open top, said cover having a circular funnel shaped surface integrally formed on and projecting from said rim downwardly into the container, and said funnel shaped surface having a bottom opening for passing refuse into the container and a plurality of secondary openings distributed through said shaped surface for the passage of fluid in the refuse while solids in the trash pass through said bottom opening, and said bottom opening having a bead defining the margin thereof to be less than the smallest dimension of the refuse carrying tray, whereby the bead strengthens said opening and arrests efforts to force the passage of the carrying tray into the container while allowing refuse to pass into the container.

* * * * *